US005302086A

United States Patent [19]

Kulesa et al.

[11] Patent Number: 5,302,086

[45] Date of Patent: Apr. 12, 1994

[54] APPARATUS FOR RETAINING ROTOR BLADES

[75] Inventors: Joseph C. Kulesa, West Chester; David E. Crawford, Jr., Cincinnati, both of Ohio

[73] Assignee: General Electric Company, Cincinnati, Ohio

[21] Appl. No.: 931,640

[22] Filed: Aug. 18, 1992

[51] Int. Cl.[5] ..... F01D 5/32

[52] U.S. Cl. ..... 416/221; 416/220 R

[58] Field of Search ..... 416/219 R, 220 R, 221

[56] References Cited

U.S. PATENT DOCUMENTS

| | | | |
|---|---|---|---|
| 2,755,062 | 7/1956 | Hill . | |
| 3,047,268 | 7/1962 | Leavitt . | |
| 3,096,074 | 7/1963 | Pratt et al. . | |
| 3,734,646 | 5/1973 | Perkins | 416/220 R |
| 3,853,425 | 12/1974 | Scalzo et al. | 416/220 R |
| 4,171,930 | 10/1979 | Brisken et al. . | |
| 4,221,542 | 9/1980 | Acres et al. . | |
| 4,304,523 | 12/1981 | Corsmeier et al. . | |
| 4,349,318 | 9/1982 | Libertini et al. . | |
| 4,457,668 | 7/1984 | Hallinger . | |
| 4,480,958 | 11/1984 | Schlechtweg . | |
| 4,566,857 | 1/1986 | Brumen . | |
| 4,668,167 | 5/1987 | Le Maoût et al. | 416/220 R |
| 4,730,983 | 3/1988 | Naudet et al. | 416/221 |
| 4,872,810 | 10/1989 | Brown et al. | 416/220 R |
| 4,890,981 | 1/1990 | Corsmeier et al. . | |
| 4,898,514 | 2/1990 | McCracken . | |
| 4,940,389 | 7/1990 | Luxenburger . | |

*Primary Examiner*—Richard A. Bertsch
*Assistant Examiner*—Christopher M. Verdier
*Attorney, Agent, or Firm*—David L. Narciso; Jerome C. Squillaro

[57] ABSTRACT

An apparatus and method for axially retaining rotor blades on a rotor disk wherein a integral split ring blade retainer is installed in a groove on a rotor disk and compressed to allow installation of rotor blades into slots on the rotor disk and releasing of the split ring blade retainer from compression causes the split ring blade retainer to engage a hook on the rotor blade and the groove on the rotor disk to react axial loads and prevent axial movement of the rotor blade with relation to the rotor disk.

10 Claims, 4 Drawing Sheets

APPARATUS FOR RETAINING ROTOR BLADES

FIELD OF THE INVENTION

This invention relates to turbomachinery rotor construction, and, more particularly, to an apparatus for retaining rotor blades on the rotor disk of a turbomachine without use of bolts.

BACKGROUND OF THE INVENTION

Turbomachinery such as high performance gas turbine engines have a compressor and turbine which each include one or more annular banks or rows of axially spaced fixed stator vanes which are positioned between rows of rotatable rotor blades. Each rotor blade is formed with a rotor tip and airfoil and a dovetail-shaped base or root which mounts within a mating, axial slot formed between adjacent dovetail posts on the rim of the rotor disk. The connection between the dovetail root of the rotor blade and the axial slot between adjacent dovetail posts on the rotor disk prevents radial and tangential movement of each rotor blade relative to the rotor disk.

In order to prevent axial movement of the rotor blades, i.e., along the longitudinal axis of the rotor disk and engine, one or more blade retainers are mounted adjacent the axial slots in the rotor disks. These blade retainers must be secured to the rotor disks strongly enough to resist the forces exerted on it by the dovetails of the rotor blades, and yet must be easily removable in order to replace the rotor blades.

The most common method of securing blade retainers to the rotor disk is by bolting, using bolts and nuts circumferentially spaced about the rotor disk. Although bolts provide a strong connection between the blade retainer and the disk, their use also presents some problems. For example, removal of bolts and nuts for maintenance purposes is time-consuming and the bolts must be carefully torqued in order to avoid overstress at the connection. Additionally, bolt holes formed in the blade retainer and rotor disk create localized concentrated stress areas which reduce the cyclic life of such parts, which is a particular concern in view of the high temperatures and high speeds at which the rotor disk and rotor blades are operated within high performance gas turbine engines, particularly within high and low pressure turbine sections. Additionally, bolt heads and nuts protruding from the disk increase the disturbance of the airflow or windage across the disk, increasing the temperature of the surrounding air and resulting in decreased engine performance.

In order to avoid the problems associated with a bolted blade retainer arrangement many boltless blade retainers have been introduced. Examples of such boltless blade retainers are shown in U.S. Pat. No. 4,304,523 to Corsmeier, et al., and U.S. Pat. No. 4,890,981 to Corsmeier, et al., both of which are assigned to the same assignee as the present invention, and the disclosures of which are incorporated herein by reference.

Although such boltless blade retainers have successfully eliminated many of the problems associated with bolted retainer assemblies, some problems remain. Particularly, such assemblies include multiple parts requiring a relatively large amount of machining. In addition to the high cost associated with such machining, maintainability requirements for a hot section component such as rotor blades that require periodic inspection and replacement necessitate an improved mounting arrangement that reduces the complexity and number of parts involved in assembly and disassembly. In addition, a design which reduces the weight of the retainer assembly is desirable.

SUMMARY OF THE INVENTION

In accordance with the present invention, it is desirable to provide an apparatus and method for retaining rotor blades on a rotor disk of a gas turbine engine, reducing the number and weight of parts required to complete the assembly of rotor blades to a rotor disk. It is also desirable to provide for axially retaining the rotor blades in the rotor disk, reacting axial airloads to the rotor disk.

The present invention provides a method and apparatus for axially retaining rotor blades on a rotor disk by providing a rotor disk with an axial blade stop surface, a radially outward facing groove in the disk rim, rotor blades including a radial surface and a radially inward facing hook, and an integral split ring blade retainer. The split ring blade retainer is mounted within the groove and compressed to enable installation of the rotor blades such that the blade roots are installed in the disk slots until the radially extending surface on the blade engages the radially extending axial blade stop surface on the disk and then releasing the split ring blade retainer so that it expands outward, engaging the hook on the rotor blade, while still being retained within the groove on the rotor disk.

An alternate embodiment in accordance with the present invention provides a circumferential recess on said split ring blade retainer and a retainer blade standoff on the blade root such that a cooling air channel is provided for metering flow through the blade root and the split ring.

These and other features and advantages of the present invention will become apparent to those skilled in the art from the detailed description of the preferred embodiments when taken in conjunction with the accompanying drawings.

BRIEF DESCRIPTION OF THE DRAWINGS

In the course of the following description, reference will be made to the accompanying drawings in which.

DESCRIPTION OF THE PREFERRED EMBODIMENT

Figure 1A:
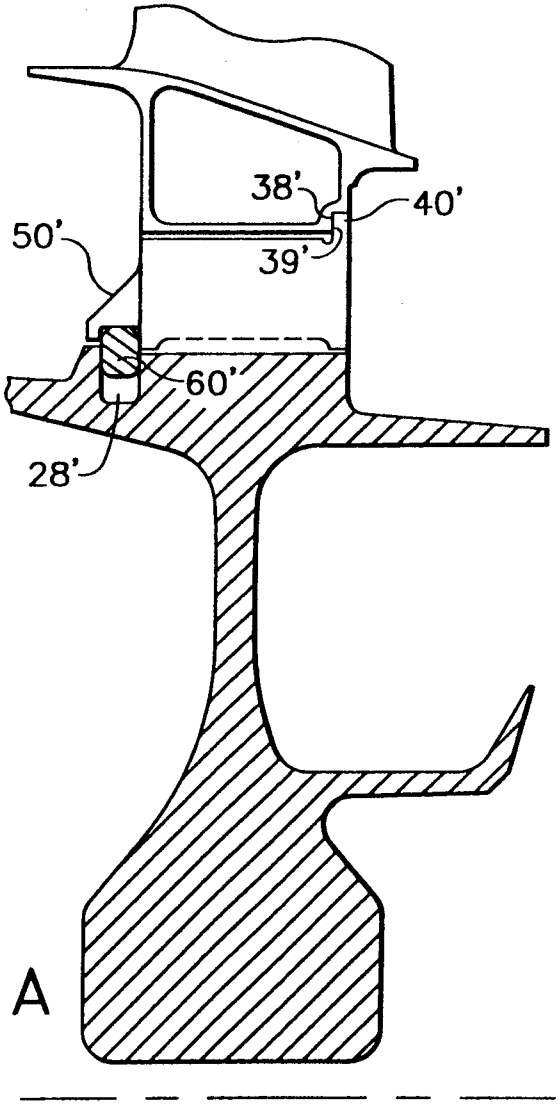
FIG. 1A is an illustration of an elevational view showing an alternate embodiment of the assembly of FIG. 1.
Figure 1:
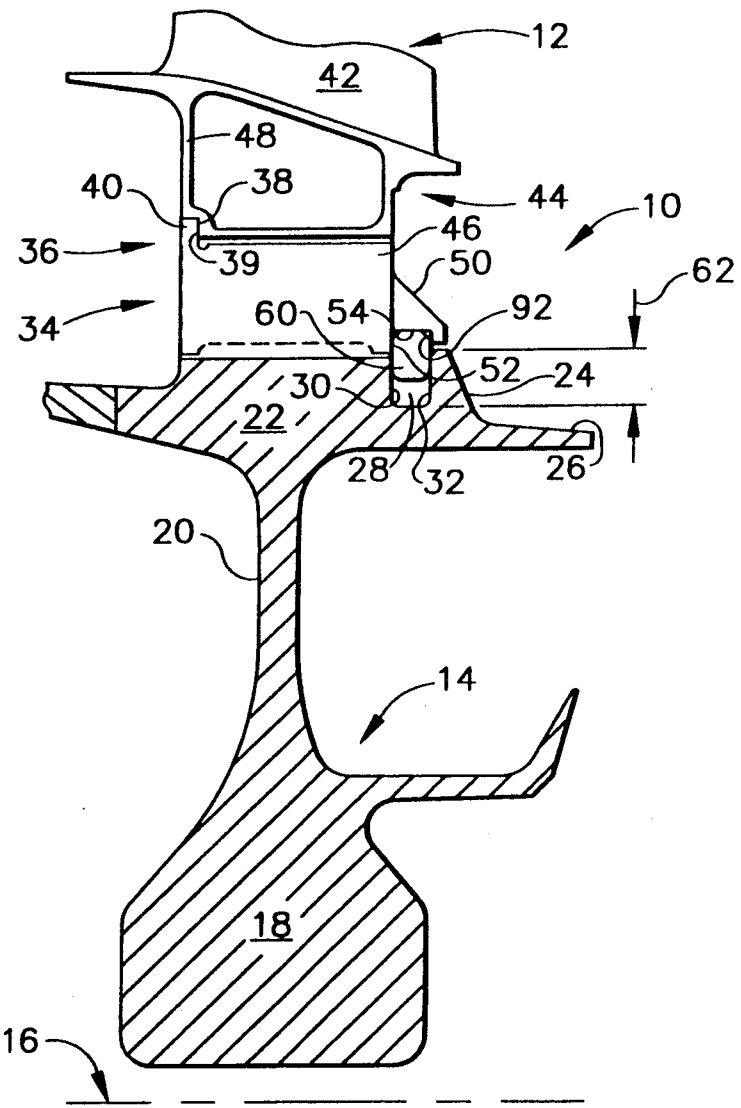
FIG. 1 is an illustration of an elevational view and partial cross section of the connection between the split ring blade retainer, rotor disk, and one rotor blade.

Like reference numerals have been used to designate like or corresponding parts throughout the several views. Referring now to FIG. 1, apparatus 10 for axially retaining rotor blades 12 on a rotor disk 14 of a gas turbine engine (not shown) is illustrated. As used herein, the term "radial" refers to a direction toward or away from the centerline 16 of rotor disk hub 18; e.g., "radially outward" denotes a direction away from the centerline 16 and "radially inwardly" denotes a direction toward the centerline 16. The term "axial" refers to a direction parallel to the longitudinal axis or centerline 16. As viewed in FIGS. 1 and 5, the term "forward" refers to the left-hand side of such figures, and the "aft" refers to the right-hand side of such figures. The term "tangentially" as used herein refers to the direction perpendicular to the centerline 16 extending into or out of the plane of the paper. The term "circumferential" refers to a circle perpendicular to and with a center on axis 16.

Figure 2:
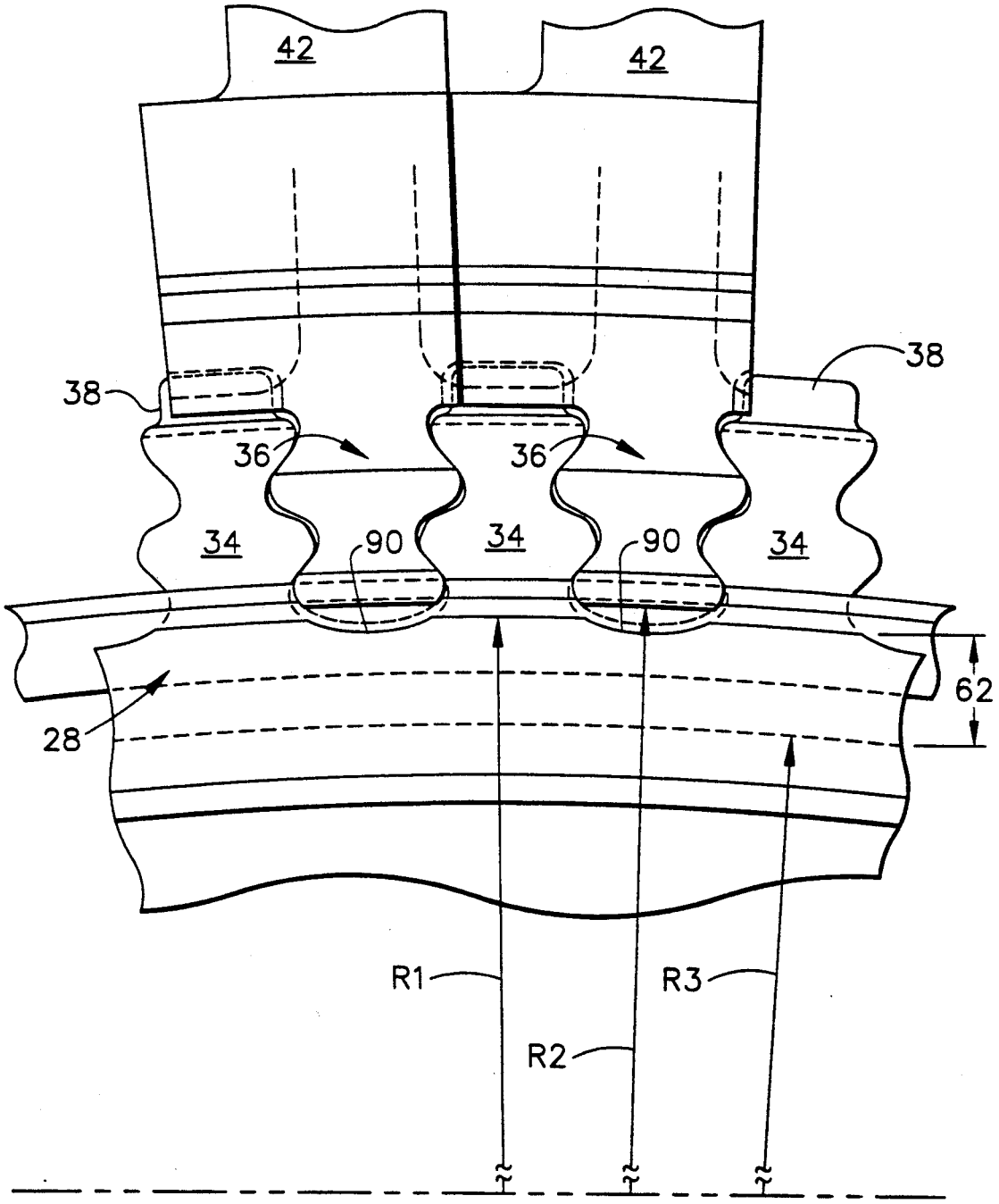
FIG. 2 is an illustration of an enlarged view of a portion of the assembly of FIG. 1, aft looking forward.

A web 20 extends radially outward from rotor disk hub 18 to a circumferential rotor disk rim 22. Rim 22 is shown as including a portion extending axially aft 24 with an angel wing seal 26 and having a circumferentially continuous outward facing groove 28 with a first annular interior wall 30, a second facing annular interior wall 32, extending radially outward and having an outer diameter defining a first radius R1 as shown in FIG. 2. Extending radially outward from the circumferential rotor disk rim 22 are a plurality of rotor blade mounting posts 34 each spaced from circumferentially adjacent mounting posts to form axial slots 36 as shown in FIG. 2. A radially extending axial blade stop surface 38 is shown on flange 40 extending outward from each rotor blade mounting post 34.

Rotor blade 12 is shown as including an airfoil 42 mounted on platform 44 with a root portion 46 extending radially inward. Rotor blade 12 is shown as including a first radially extending surface 39 for engaging the rotor disk axial blade stop surface 38 on a blade skirt 48. Root portion 46 includes a radially inward facing hook 50 having a radially extending interior wall 52 and an axially extending interior wall 54 extending away from the radially extending interior wall 52, having a second radius R2. A split ring blade retainer 60 is shown mounted within the inward facing hook 50 and also as engaging groove 28 in rotor disk 14. Groove 28 has a depth 62 such that an inner circumferential wall 66 between first and second annular interior walls 30 and 32 respectively defines a third radius R3, such that split ring blade retainer 60 maybe compressed within groove 28.

Figure 3:
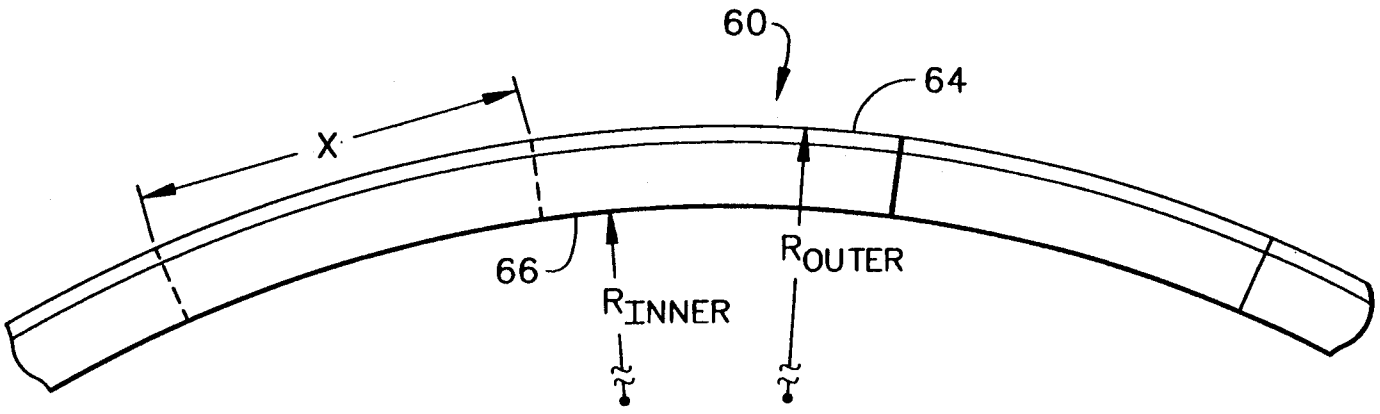
FIG. 3 is an illustration of a fragmentary view of a portion of the split ring blade retainer.
Figure 4:
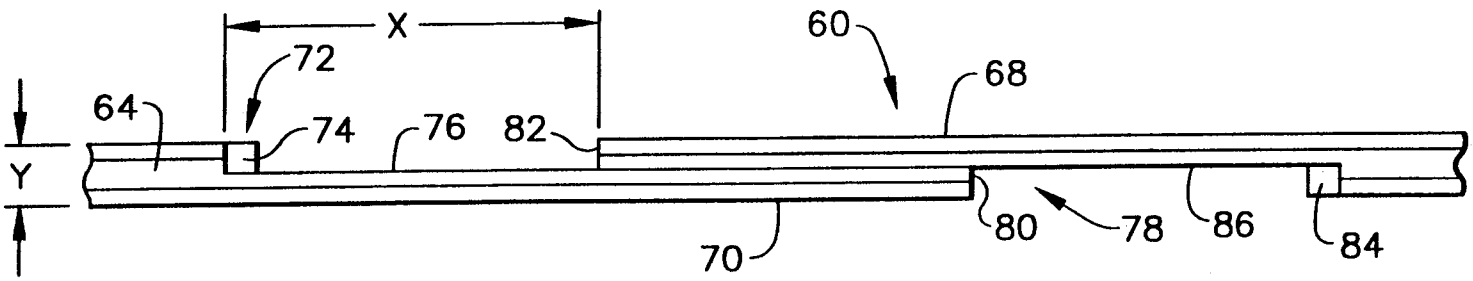
FIG. 4 is an illustration of a plan view of the split ring blade retainer of FIG. 3.

Referring now to FIGS. 3 and 4, split ring blade retainer 60 is shown as including an outer circumferential surface 64 having an undeflected radius substantially the same as the second radius R2 and an inner circumferential surface 66 having an undeflected radius less than first radius R1. Split ring blade retainer 60 is further shown as including a first annular surface 68 for engaging the groove first annular interior wall 30 and the hook radially extending interior wall 52 and a second opposite annular surface 70 for engaging the groove second annular interior wall 32. The first annular surface 68 is shown as including a first radial cut 72 across the first annular surface 68 and extending axially part way through ring 60 defining a first radially extending axial surface 74. A planar portion 76 extends circumferentially from the first radially extending axial surface 74 to a second radial cut 78 extending from the circumferential planar portion 76 to the second annular surface 70 and defining a second radially extending axial surface 80. Corresponding third and fourth radially extending surfaces 82 and 84 are separated by a corresponding circumferential planar portion 86. In undeflected position, as shown in FIGS. 3 and 4, split ring blade retainer 60 has radially extending axial surfaces 74 and 82, and surfaces 80 and 84 spaced from each other and the circumferential planar surfaces 76 and 86 are slidingly engaged such that the radius of the outer circumference of the split ring blade retainer 60 may be adjusted from the second radius R2 to the first radius R1 by compressing the first and third radially extending axial surfaces 74 and 82 towards each other, the circumferential planar surfaces 76 and 86 sliding along each other to allow such circumferential movement also causing the second and fourth radially extending axial surfaces 80 and 84 to move towards each other.

In the preferred embodiment depicted in FIGS. 1 and 2 the split ring 60 can be compressed into the groove 28 such that the rotor blades 12 may be removed, the root portion 46 sliding out of the dovetail slot 36. Groove 28 is also shown as including scallops 90 such that the second interior wall 32 will not interfere with insertion and removal of rotor blades 12. Assembly of rotor blades 12 into rotor disk 14 is accomplished by inserting split ring blade retainer in circumferential groove 28 and compressing the outer circumferential surface 64 such that corresponding radially extending axial surfaces 74 and 82, and 80 and 84, slide towards each other with an allowable circumferential movement depicted along the outer circumference in an undeflected position as the distance X in FIG. 3, such that the radius may be reduced with the inner radius of split ring blade retainer 60 also being reduced such that the minimum inner radius that can be achieved is the third radius R3 of the inner circumferential wall 66. With the split ring blade retainer in a deflected compressed position rotor blades 12 may be installed by inserting root portions 46 into rotor disk axial slots 36 until the first radially extending surface 39 engages the rotor disk radially extending axial blade stop surface 38. Once all rotor blades have been installed the split ring blade retainer 60 may be released from its deflected position and will then engage hook 50 while still being engaged in groove 28. The axially extending interior wall 54 of hook 50 restrains radially outward expansion of split ring blade retainer 60. During engine operation split ring blade retainer 60 is subjected to centrifugal forces thus applying additional forces to the axially extending interior wall 54 of hook 50. An important feature of the invention is the groove 28 which acts to not only retain the split ring blade retainer from axial movement fore and aft but in the event of failure or breakage of the split ring blade retainer 60 will retain the broken pieces in their axial position, continuing to restrain the rotor blade 12 from axial movement. Centrifugal forces will keep the broken pieces forced radially outward and engaging the hook until the rotor has slowed, at which time the axial loads on the rotor blade would be minimized. In the embodiment shown, any axial air loads in the aft direction would be reacted through the split ring blade retainer to the rotor disk via the second facing annular interior wall 32. It is clear that the relative positioning and direction of the axial blade stop surface 38 and the corresponding radially extending surface 39 with relation to the split ring blade retainer 60, hook 50, and groove 28, could be reversed, as shown in FIG. 1A, such that installation of the blade would be from the forward side and in that situation the axial air loads would be reacted through the radially extending blade stop surface 38, while the split ring blade retainer 60 would be effective for preventing forward axial movement. It is further apparent that the radially extending blade stop surface 38 and the radially extending surface 39 on rotor blade 12 could be eliminated and the hook 50, groove 28, and split ring blade retainer 60 assembly could be used with the hook 50 having a second radially extending interior wall 92 such that the split ring blade retainer 60 would react axial loads in both directions.

The apparatus reduces the number and complexity of parts for retaining blades from axial movement and retaining the retainer in position from what was taught previously. Further, by eliminating intermediate apparatus and using an integral boltless blade retainer substantial weight savings are accrued in addition to simplicity in manufacturing and ease in assembly. Furthermore, the apparatus provides a configuration which reduces the localized stress areas in the assembly. Reducing the local concentrated stress areas is desirable in order to reduce the material required for the rotor disk.

Figure 5:
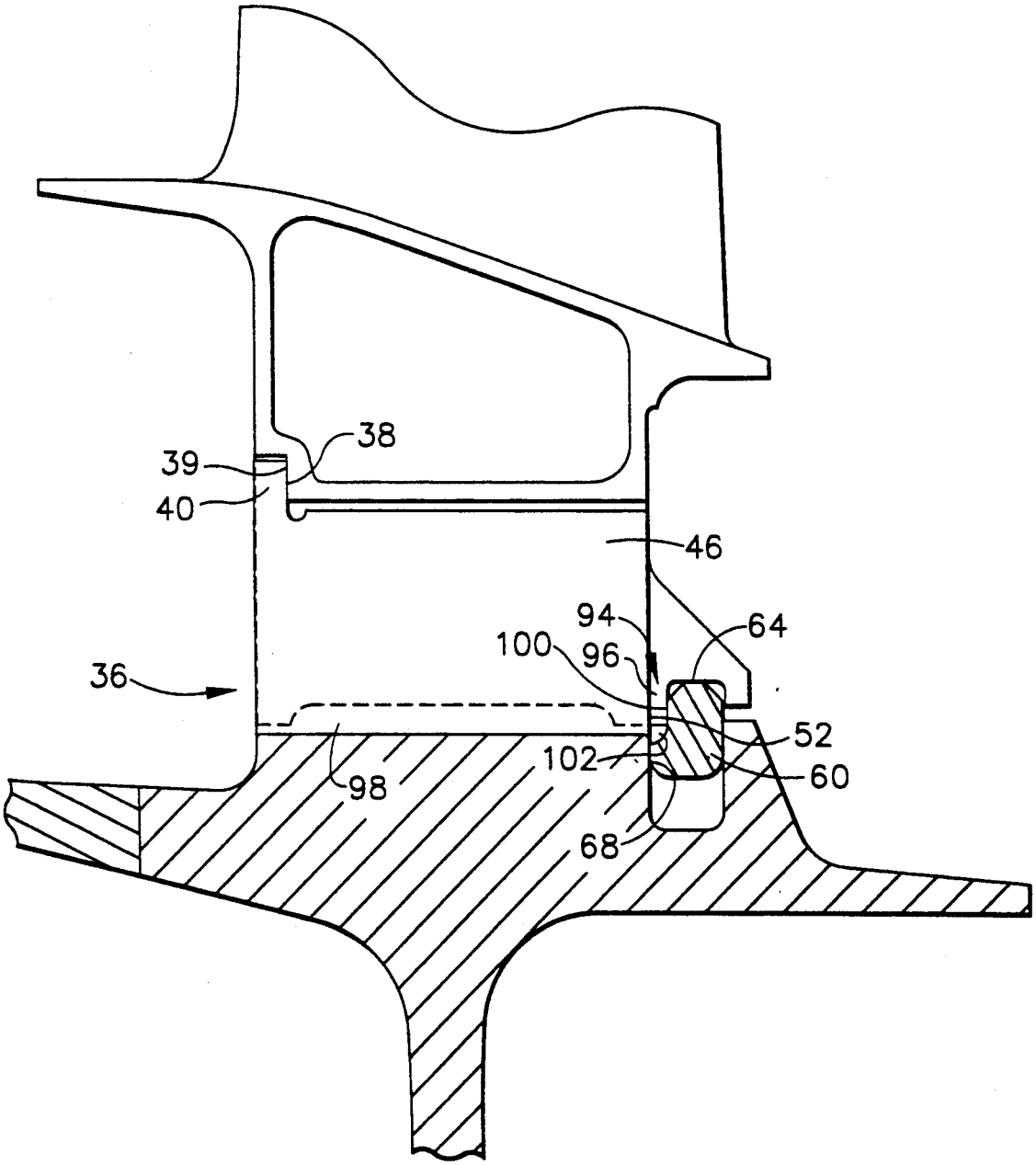
FIG. 5 is an illustration of an enlarged cross-sectional view showing an alternate embodiment of the assembly of FIG. 1.

FIG. 5 depicts an alternate embodiment of the split ring blade retainer showing the split ring blade retainer 60 as including a circumferentially continuous recess 94 and the rotor blade root portion 46 as including a retainer blade stand-off 96 extending axially aft from radially extending interior wall 52. Axial slots 36 include a channel 98 beneath the installed rotor blade root portion 46. Circumferential recess 94 includes a surface 100 extending radially inwardly from the outer circumferential surface 64 and curving until it reaches the first annular surface 68, thus making a circumferential channel 102. Cooling airflow thus can flow through channel 98 underneath the root portion 46 and then turning to flow tangentially in circumferential channel 102 on the aft side of the rotor blade 12 and finally turning to flow radially outward through the channel locally created between the continuous recess surface and the disk post surface thus cooling both the rotor blade root portion 46 and the rotor disk mounting post 34. Proper design of this split ring blade retainer disk and slot features will allow accurate metering of such cooling flow to optimize performance of the engine.

The present invention and many of its intended advantages will be understood from the foregoing description and it will be apparent that various changes may be made in the form, construction, and arrangement of the parts thereof without departing from the spirit and scope of the invention or sacrificing its material advantages, the apparatus and method hereinabove described being a preferred and exemplary embodiment.

We claim:

1. Apparatus for axially retaining rotor blades on a rotor disk of a gas turbine engine, each rotor blade having a root portion, the rotor disk having a web extending radially outward from a hub to a circumferential rotor disk rim and rotor blade mounting posts extending radially outward from said rim, each mounting post spaced from circumferentially adjacent mounting posts forming axial slots therebetween, each slot substantially complementary to said root portion, said mounting posts retaining said rotor blades radially and circumferentially, said apparatus comprising:

said rotor disk including:

a blade stop mounted on said rotor blade mounting post and providing a radially extending axial blade stop surface; and a circumferentially continuous outward facing groove in said rim including a first annular interior wall extending radially to said mounting posts, a second, facing, annular interior wall having an outer diameter defining a first radius, and a depth with a third radius;

each of said rotor blades including:

said root portion configured for substantially filling and providing substantially continuous surface contact with said complementary slot;

a first radially extending surface for engaging said stop surface; and a radially inward facing hook including a radially extending interior wall and an axially extending interior wall, defining a second radius, extending away from said radially extending interior wall; and a single split ring blade retainer mounted within said inward facing hook, said split ring blade retainer comprising:

an outer circumferential surface with a radius substantially the same as said second radius;

an inner circumferential surface having a radius less than said first radius;

a first annular surface engaging said groove first annular interior wall and said hook radially extending interior wall;

a second, opposite, annular surface engaging said groove second annular interior wall;

such that said split ring blade retainer is restrained radially by said outer circumferential surface engaging said hook axial extending surface and restrained axially by said first and second annular surfaces engaging said groove walls;

whereby said rotor blades are restrained from axial movement in one direction by said rotor blade first radially extending surface engaging said axial blade stop surface and restrained from axial movement in a second, opposite, direction by said radially extending interior wall engaging said split ring first annular surface.

2. Apparatus for axially retaining rotor blades as in claim 1 wherein said groove has a depth with a third radius enabling compression of said split ring outer circumferential surface to reduce said radius of said outer circumferential surface to a radius substantially the same as said first radius, enabling axial movement of said rotor blades for installation and removal from said rotor disk.

3. Apparatus for axially retaining rotor blades on a rotor disk of a gas turbine engine, each rotor blade having a root portion, the rotor disk having a web extending radially outward from a hub to a circumferential rotor disk rim and rotor blade mounting posts extending radially outward from said rim, each mounting post spaced from circumferentially adjacent mounting posts forming axial slots therebetween, each slot substantially complementary to said root portion, said mounting posts retaining said rotor blades radially and circumferentially, said apparatus comprising:

said rotor disk including:

a radially extending axial blade stop surface; and a circumferentially continuous outward facing groove in said rim including a first annular interior wall extending radially to said mounting posts, a second, facing, annular interior wall having an outer diameter defining a first radius, and a depth with a third radius;

each of said rotor blades including:

a first radially extending surface for engaging said stop surface; and a radially inward facing hook including a radially extending interior wall and an axially extending interior wall, defining a second radius, extending away from said radially extending interior wall; and a split ring blade retainer mounted within said inward facing hook, said split ring blade retainer comprising:

an outer circumferential surface with a radius substantially the same as said second radius;

an inner circumferential surface having a radius less than said first radius;

a first annular surface engaging said groove first annular interior wall and said hook radially extending interior wall;

a second, opposite, annular surface engaging said groove second annular interior wall;

a first radial cut across said first annular surface extending axially partway through said ring, defining a first radially extending axial surface;

a planar portion extending circumferentially from said first radially extending axial surface;

a second radial cut extending from said circumferential planar portion to said second annular surface, defining a second radially extending axial surface; and corresponding third and fourth radially extending surfaces separated by a corresponding circumferential planar portion and spaced from said first and second radially extending surfaces such that said radius of said circumference may be adjusted from said second radius to said first radius by compressing said first and third radially extending axial surfaces towards each other, said circumferential planar surfaces slidingly engaged allowing circumferential movement, whereby said second and fourth radially extending axial surfaces also are moved towards each other;

such that said split ring blade retainer is restrained radially by said outer circumferential surface engaging said hook axial extending surface and restrained axially by said first and second annular surfaces engaging said groove walls, and wherein said groove third radius enables compression of said split ring outer circumferential surface to reduce said radius of said outer circumferential surface to a radius substantially the same as said first radius, enabling axial movement of said rotor blades for installation and removal from said rotor disk;

whereby said rotor blades are restrained from axial movement in one direction by said rotor blade first radially extending surface engaging said axial blade stop surface and restrained from axial movement in a second, opposite, direction by said radially extending interior wall engaging said split ring first annular surface.

4. Apparatus as in claim 1 wherein said blade stop surface extends from said rotor blade mounting post and said rotor blade first radially extending surface extends from a blade skirt.

5. Apparatus as in claim 1 wherein said blade stop surface prevents axial movement of said blade in a forward direction and said split ring blade retainer prevents axial movement of said blade in an aft direction.

6. Apparatus as in claim 1 wherein said blade stop surface prevents axial movement of said blade in an aft direction and said split ring blade retainer prevents axial movement of said blade in a forward direction.

7. Apparatus for axially retaining rotor blades on a rotor disk of a gas turbine engine, each rotor blade having a root portion, the rotor disk having a web extending radially outward from a hub to a circumferential rotor disk rim and rotor blade mounting posts extending radially outward from said rim, each mounting post spaced from circumferentially adjacent mounting posts forming axial slots therebetween, each slot substantially complementary to said root portion, said mounting posts retaining said rotor blades radially and circumferentially, said apparatus comprising:

said rotor disk including:

a radially extending axial blade stop surface; and a circumferentially continuous outward facing groove in said rim including a first annular interior wall extending radially to said mounting posts and a second, facing, annular interior wall having an outer diameter defining a first radius;

each of said rotor blades including:

a first radially extending surface for engaging said stop surface; and a radially inward facing hook including a radially extending interior wall and an axially extending interior wall, defining a second radius, extending away from said radially extending interior wall; and a split ring blade retainer mounted within said inward facing hook having an outer circumferential surface with a radius substantially the same as said second radius, an inner circumferential surface having a radius less than said first radius, a first annular surface engaging said groove first annular interior wall and said hook radially extending interior wall and a second, opposite, annular surface engaging said groove second annular interior wall;

such that said split ring blade retainer is restrained radially by said outer circumferential surface engaging said hook axial extending surface and restrained axially by said first and second annular surfaces engaging said groove walls;

whereby said rotor blades are restrained from axial movement in one direction by said rotor blade first radially extending surface engaging said axial blade stop surface and restrained from axial movement in a second, opposite, direction by said radially extending interior wall engaging said split ring first annular surface;

wherein said split ring blade retainer includes a circumferentially continuous recess having a first surface extending radially inwardly from said outer circumference joining a second surface extending axially from said first annular surface towards said second annular surface; and wherein a retainer blade stand-off extends axially from said radially extending interior wall for engaging said recess first surface; such that a metered cooling air flow circuit is enabled through a channel along the bottom of said axial slot continuous with a channel through said recess.

8. Apparatus as in claim 7 wherein said split ring blade retainer is located aft of said rotor blades, whereby air loads forcing said rotor blades axially aft are reacted to said rotor disk through said split ring blade retainer.

9. Apparatus as in claim 7 wherein said split ring blade retainer is located forward of said rotor blades, whereby said split ring blade retainer prevents forward axial movement of said rotor blades, and wherein said radially extending blade stop surface is located aft of said rotor blade first radially extending surface, whereby air loads forcing said rotor blades axially aft are reacted to said rotor disk through said blade stop surface.

10. Apparatus as in claim 1 wherein in the event of failure of said split ring, said split ring will be retained in said groove when centrifugal force does not force said ring into engagement with said hook.

* * * * *